United States Patent [19]

Walsh

[11] 4,348,194

[45] Sep. 7, 1982

[54] COWL FOR AN OUTBOARD MOTOR

[75] Inventor: James R. Walsh, Oshkosh, Wis.

[73] Assignee: Brunswick Corporation, Skokie, Ill.

[21] Appl. No.: 164,976

[22] Filed: Jul. 1, 1980

[51] Int. Cl.[3] ..... B63H 21/00

[52] U.S. Cl. ..... 440/77; 123/195 P

[58] Field of Search ..... 440/77, 900, 76; 123/195 P, 195 C, 198 E; 30/386, 385, 384, 383, 382, 381

[56] References Cited

U.S. PATENT DOCUMENTS

| | | | |
|---|---|---|---|
| 2,296,240 | 9/1942 | Blum | 30/385 |
| 2,600,181 | 6/1952 | Armstrong . | |
| 2,676,559 | 4/1954 | Davies | 440/77 X |
| 2,911,937 | 11/1959 | Kiekhaefer | 440/77 |
| 3,195,521 | 7/1965 | Larson | 123/195 P |
| 3,358,668 | 12/1967 | Post | 440/77 X |
| 3,395,684 | 8/1968 | Minks | 123/198 E |
| 3,773,010 | 11/1973 | Elingsen | 440/77 |
| 3,955,526 | 5/1976 | Kusche | 440/77 |

*Primary Examiner*—Trygve M. Blix
*Assistant Examiner*—Stephen P. Avila
*Attorney, Agent, or Firm*—O. T. Sessions

[57] ABSTRACT

A cowl for the power head (11) of an outboard motor (10) includes two bottom cowl members (14, 15) attached together by screws which also mount a latch bracket (26) and a hinge member (25). The latch bracket (26) supports a latch mechanism which, with the hinge member (25) serves to hold a top cowl member (13) in place.

8 Claims, 3 Drawing Figures

COWL FOR AN OUTBOARD MOTOR

DESCRIPTION

Technical Field

This invention relates to outboard motors and particularly to removable cowls for enclosing the internal combustion engine or power head of an outboard motor.

Background Art

Outboard motors generally include a cowl to enclose the engine or power head. The cowl is required to provide engine silencing, to protect the power head from water and weather, to provide ready access to the power head, and to protect boat occupants from accidental contact with the power head.

A one-piece lower cowl member mounted between the drive shaft housing and the power head is used in many instances with a one-piece upper cowl member latched to the lower cowl. Typically the upper cowl member is supported primarily by the lower cowl member. This arrangement is particularly suitable for small outboard motors where the relatively small upper cowl can be readily manipulated.

For larger outboards clam-shell cowls such as those shown in U.S. Pat. Nos. 3,773,010 and 3,955,526 have been used. In such constructions starboard and port cowl sections enclose the power head.

Another cowl arrangement shown in U.S. Pat. No. 3,358,668 has a support frame assembly mounted on the power head with an upper and lower cowl member attached to the frame. An intermediate wrap-around cowl structure is supported by the upper and lower cowl members.

Disclosure of Invention

An outboard motor with a drive shaft housing and an engine supported on the drive shaft housing has a cowl assembly surrounding the engine. The cowl assembly includes two bottom cowl members fitting together around the drive shaft housing. A top cowl member joins with the two bottom cowl members to enclose the engine.

The outboard motor can include a latch assembly having a latch bracket attached to both of the bottom cowl members to hold them together with a latch member pivoted on the bracket to latch the top cowl member to the two bottom cowl members. Opposite the latch assembly a releasable hinge can be clamped between the bottom cowl members to releasably hinge the top cowl member to the two bottom cowl members.

The two bottom cowl members may have grooves engaging a flange around the upper periphery of the drive shaft housing to retain the bottom cowl members in place.

Figure 1:
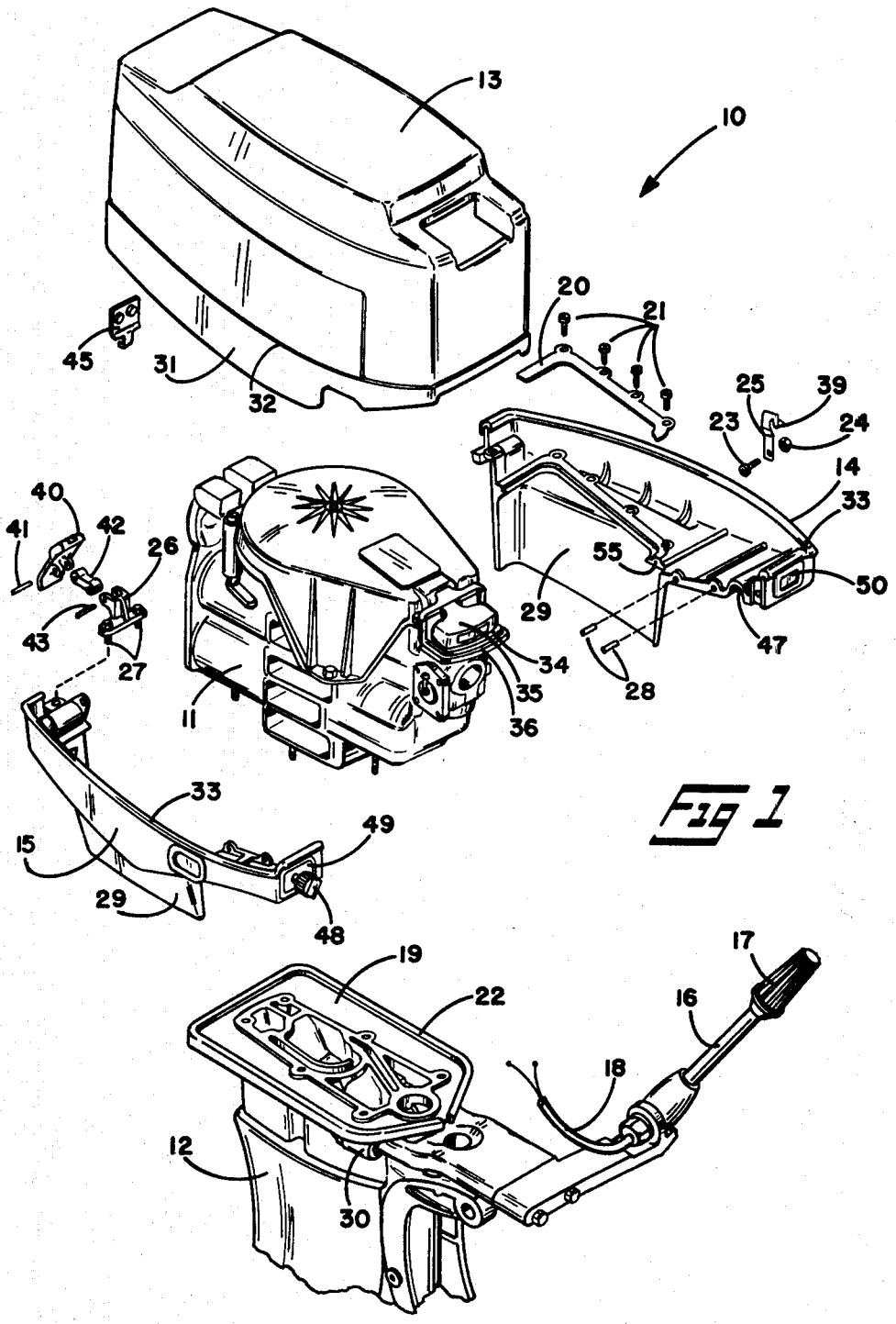
FIG. 1 is an exploded view of the outboard motor of the invention.
Figure 2:
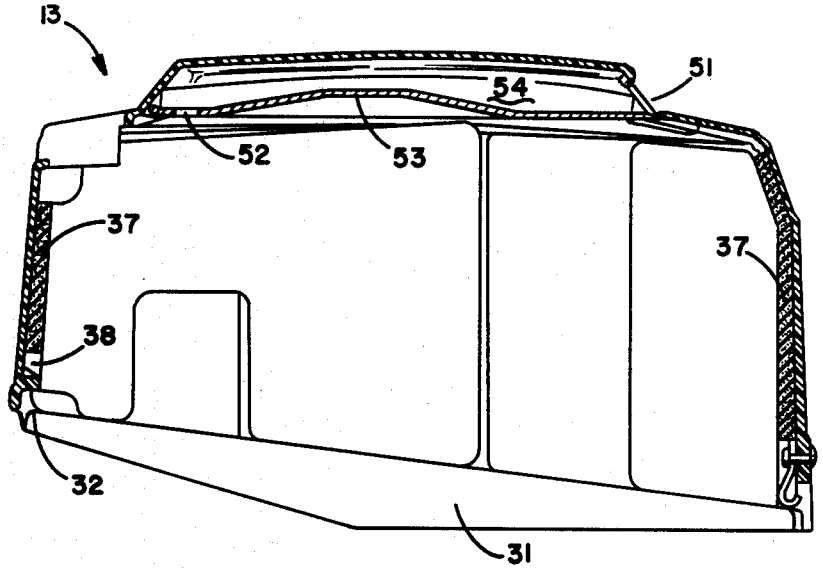
FIG. 2 is a sectional view of the top cowl member of the motor shown in FIG. 1.

Best Mode for Carrying Out the Invention

The outboard motor 10 shown in the figures includes an engine or power head 11 mounted on a drive shaft housing 12. The engine 11 is operatively connected to a drive shaft, not illustrated, which extends downward to drive a propeller, not illustrated. A cowl assembly having three major pieces, a top cowl member 13 and two bottom cowl members 14 and 15 formed of sheet molding compound (glass reinforced polyester) encloses the power head 11. A steering handle 16 attached to the drive shaft housing 12 includes a twist grip throttle and shift controller 17 which actuates control cables 18 which in turn operate a throttle and shift linkage, not illustrated, on the power head 11.

The bottom cowl members 14 and 15 are supported by the top of the drive shaft housing 12 by a flange 19 encircling the housing 12. A groove is formed by plates 20 attached with screws 21 to the bottom cowl members 14 and 15. The groove encircles the drive shaft housing 12 and meshes with the flange 19. A rubber seal 22 mounted on the flange 19 provides a water-tight joint between the bottom cowl members 14 and 15 and the drive shaft housing 12. The two bottom cowl members 14 and 15 are held together at the front by the bolt 23 and nut 24 at the front which passes through the hinge member 25 and at the rear by the latch bracket 26 and two screws 27. Two pins 28 inserted between the bottom cowl members 14 and 15 keep the forward portion of the cowl members aligned. A skirt 29 below the flange 19 conceals the upper shock mounts 30. Thus an attractive lower cowl is provided which can be easily removed for servicing the lower end of the power head 11.

The top cowl member 13 fits over the two bottom cowl members 14 and 15 and has a skirt 31 which fits around the outside of the bottom cowl members 14 and 15. An internal shoulder 32 at the top of the skirt 31 rests on the seal 33 at the top rim of the bottom cowl assembly to provide vertical support for the top cowl member 13. A starter handle support 34 is mounted on the power head 11 and provides additional support for the top cowl member 13. The starter handle support 34 fills the opening in the top cowl member 13 provided for the starter rope handle 35 and has a rim 36 which projects under the edges of the opening to support the top cowl member 13 and seal the opening. A plastic foam blanket 37 is provided inside the top cowl member 13 for sound insulation.

The top cowl member 13 is held in place by a releasable hinge at the front and a latch at the rear. The releasable hinge is formed by a hinge member 25 and a notch 38 in the top cowl member 13. The hinge member 25 is clamped between the two bottom cowl members by the nut 24 and bolt 23 which holds the bottom cowl members 14 and 15 together. A forward facing hook 39 is formed on the hinge member 25 and engages the rearward facing notch 38 in the top cowl 13.

Figure 3:
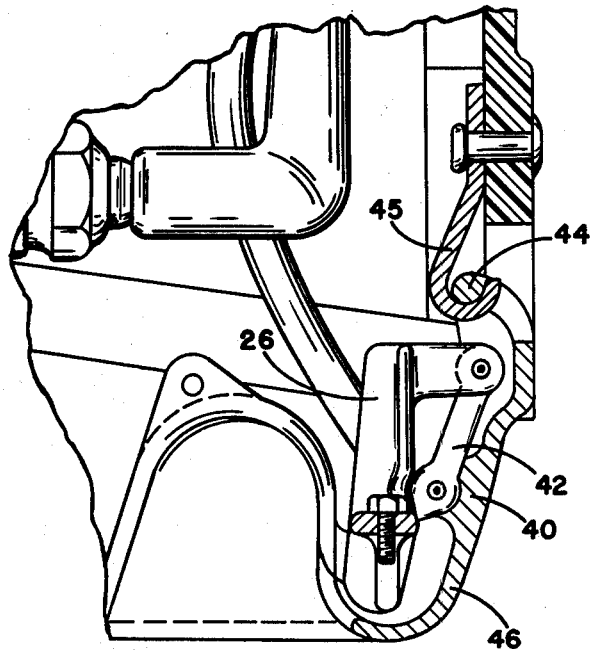
FIG. 3 is an enlarged sectional view illustrating the latch mechanism shown in FIG. 1.

At the rear of the cowl the latch includes a latch member 40 pivotally attached by a pin 41 to a latch link 42 which in turn is pivotally attached by another pin 43 to the latch bracket 26 which is attached to the two bottom cowl members 14 and 15. As most clearly shown in FIG. 3, the latch member 40 has a catch 44 at one end which engages a hook 45 attached by rivets to the top cowl member 13. The other end of the latch member 40 provides a handle 46 for operating the latch. The latch link 42 and latch member 40 thus form an over-center type of latch, shown in the locked position in FIG. 3, which can be easily operated by means of the handle 46 on the latch member 40. The entire latch mechanism fits in a recess formed by the bottom cowl members, with the outer shape of the latch member 40 generally conforming to the contour of the cowl to provide a pleasing appearance.

Several apertures are provided in the cowl to serve necessary functions. An entrance for the shift and throttle control cable is provided by a groove 47 in the bottom cowl member 14 on the port side, with no corresponding groove on the starboard side. Thus an aperture is provided through the bottom of the cowl at the center line between the two bottom cowl members. Two apertures are provided at the front of the cowl to accommodate an engine choke control 48 and a fuel line connection. These apertures are partially closed by rubber grommets 49 and 50. An air inlet to supply combustion air to the engine is provided through the top cowl member 13. The air inlet includes an opening 51 at the rear of the cowl and an opening 52 through the forward end of the plate 53 forming the bottom of the air inlet passage 54. An additional opening 55 is provided between the bottom cowl members 14 and 15 and the front of the drive shaft housing 12 to allow drainage of any liquids which might enter the cowl.

I claim:

1. An outboard motor including:

(A) a drive shaft housing;

(B) an engine supported on said drive shaft housing; and (C) a cowl assembly surrounding said engine, said cowl assembly comprising:

(1) a first bottom cowl member, (2) a second bottom cowl member, said bottom cowl members fitting together around said drive shaft housing below said engine, (3) a top cowl member joined with said bottom cowl members to enclose said engine, and (4) a latch means to hold said cowl members together, said latch means comprising a bracket attached to both of said bottom cowl members.

2. The outboard motor defined in claim 1 wherein said latch means further comprises a latch member pivotally connected to said bracket and a hook on said top cowl member, said latch member releasably engaging said hook.

3. The outboard motor defined in claim 2 wherein said latch means further comprises a latch link member pivotally connected to said bracket and said latch member to form an over-center latching mechanism.

4. The outboard motor defined in claim 1 further comprising a releasable hinging means located on said cowl opposite said bracket to releasably hinge said top cowl member to said bottom cowl members.

5. The outboard motor defined in claim 4 wherein said hinging means comprises one hinge member clamped between said first and second bottom cowl members.

6. An outboard motor including:

(A) a drive shaft housing having a flange around its upper periphery;

(B) an engine supported on said drive shaft housing; and (C) a cowl assembly surrounding said engine, said cowl assembly comprising:

(1) a first bottom cowl member, (2) a second bottom cowl member, said bottom cowl members fitting together around said drive shaft housing below said engine to be supported by said flange, and (3) a top cowl member joined with said bottom cowl members to enclose said engine.

7. The outboard motor defined in claim 6 wherein said bottom cowl members comprise grooves for engaging said flange.

8. The outboard motor defined in claim 7 wherein said drive shaft housing further comprises sealing means mounted on said flange to provide a seal between said flange and said bottom cowl members.

* * * * *